US005478258A

United States Patent [19]

Wang

[11] Patent Number: 5,478,258

[45] Date of Patent: Dec. 26, 1995

[54] BNC CONNECTOR AND PC BOARD ARRANGEMENT

[76] Inventor: Tsan-Chi Wang, 1 Fl., No. 13, Lane 312, Chung Chen Road, Hsin Tien, Taipei Hsien, Taiwan

[21] Appl. No.: 169,102

[22] Filed: Dec. 20, 1993

[51] Int. Cl.[6] ..... H01R 9/05

[52] U.S. Cl. ..... 439/581; 439/63

[58] Field of Search ..... 439/581, 63, 62, 439/79, 80

[56] References Cited

U.S. PATENT DOCUMENTS

| | | | |
|---|---|---|---|
| 3,539,966 | 11/1970 | Logan | 439/63 |
| 4,125,308 | 11/1978 | Schilling | 439/63 |
| 4,598,961 | 7/1986 | Cohen | 439/581 |
| 4,659,156 | 4/1987 | Johnescu | 439/63 |
| 4,674,809 | 6/1987 | Hollyday | 439/63 |
| 4,797,120 | 1/1989 | Ulery | 439/578 |
| 4,884,982 | 12/1989 | Fleming | 439/620 |
| 5,169,343 | 12/1992 | Andrews | 439/581 |
| 5,215,470 | 6/1993 | Henry | 439/581 |

*Primary Examiner*—Kurt Rowan

*Attorney, Agent, or Firm*—Lowe, Price, LeBlanc & Becker

[57] ABSTRACT

A BNC connector and printed circuit board arrangement includes a PC board and a BNC connector having an insulative body fastened to the rectangular side opening of the PC board and signal and ground terminals connected to the PC board, the insulative body of the BNC connector having two elongated grooves at two opposite sides, which receives the two opposite lateral side walls of the rectangular opening of the PC board, and two wing portions at two opposite sides respectively affixed to the back side of the PC board by self-tapping screws.

6 Claims, 10 Drawing Sheets

BNC CONNECTOR AND PC BOARD ARRANGEMENT

BACKGROUND OF THE INVENTION

The present invention relates to an electrical connector for connecting a coaxial cable to a printed circuit board, and more particularly, to features of the connector providing wing portions to hold the printed circuit board.

U.S. Pat. No. 4,797,120 discloses a coaxial connector having filtered ground isolation means for mounting to a printed circuit board, U.S. Pat. No. 4659,156 discloses a coaxial connector with circuit board mounting features for the same purpose. U.S. Pat. No. 4,884,982 discloses a capacitive coupled connector for the same purpose. These electrical connectors have a common feature, i.e. each connector has two posts vertically disposed at the bottom for pluggable receipt into respective PCB apertures. When plugged into the PCB apertures, the posts are then welded to the PC board, as shown in FIG. 1.

When installed, the whole assembly of the BNC connector (includes the insulative body and the BNC jack) is upstanding from the PC board at one side, therefore the BNC connector occupies much installation space at one side of the PC board, and the size of the outer shell which receives the PC board and the BNC connector must be relatively increased. As the BNC connector is connected to the PC board simply by the two posts thereof, the binding force is weak, and the connection between the BNC connector and the PC board may be damaged easily.

SUMMARY OF THE INVENTION

The present invention has been accomplished to provide a BNC connector and PC board arrangement which eliminates the aforesaid drawbacks.

According to one aspect of the present invention, the BNC connector and PC board arrangement includes a PC board having a rectangular side opening, and a BNC connector having an insulative body received in the rectangular side opening of the PC board, therefore the BNC connector has two opposite parts respectively disposed at two opposite sides relative to the PC board, and less installation space above the PC board is occupied.

According to another aspect of the present invention, the BNC connector comprises two elongated grooves at two opposite sides, which receives the two opposite lateral sides of the rectangular side opening of the PC board, and two wing portions at two opposite sides, which respectively stop at the back side of the PC board and affixed thereto by self-tapping screws.

According to still another aspect of the present invention, capacitor elements are mounted within top through holes on the insulative body and connected between the ground terminal of the BNC connector and a metal clip to form a filter circuit.

DETAILED DESCRIPTION OF THE PREFERRED EMBODIMENTS

Figure 1:
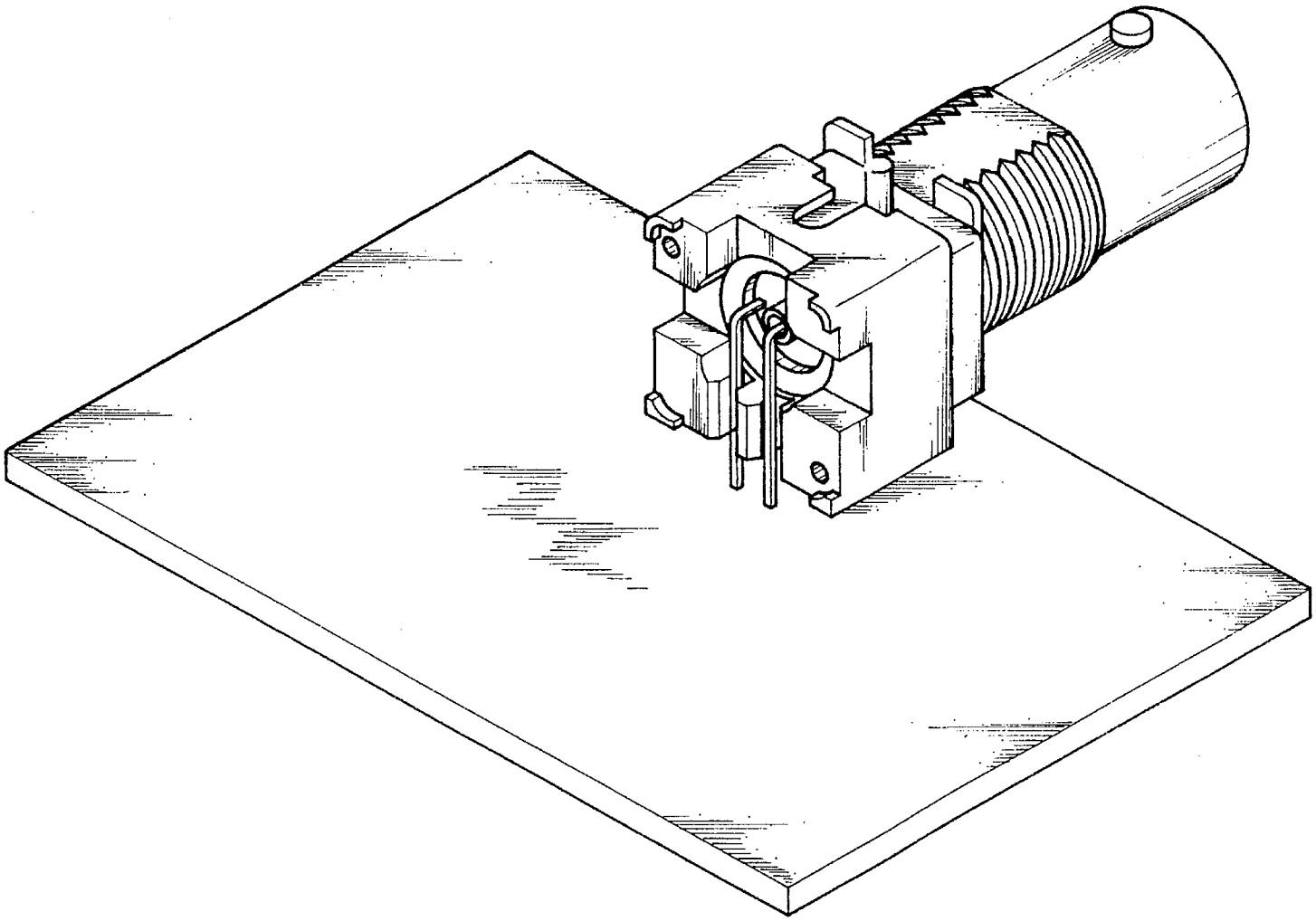
Fig. 1 PRIOR ART
FIG. 1 is an elevational view of a prior art BNC connector installed in a printed circuit board.
Figure 2:
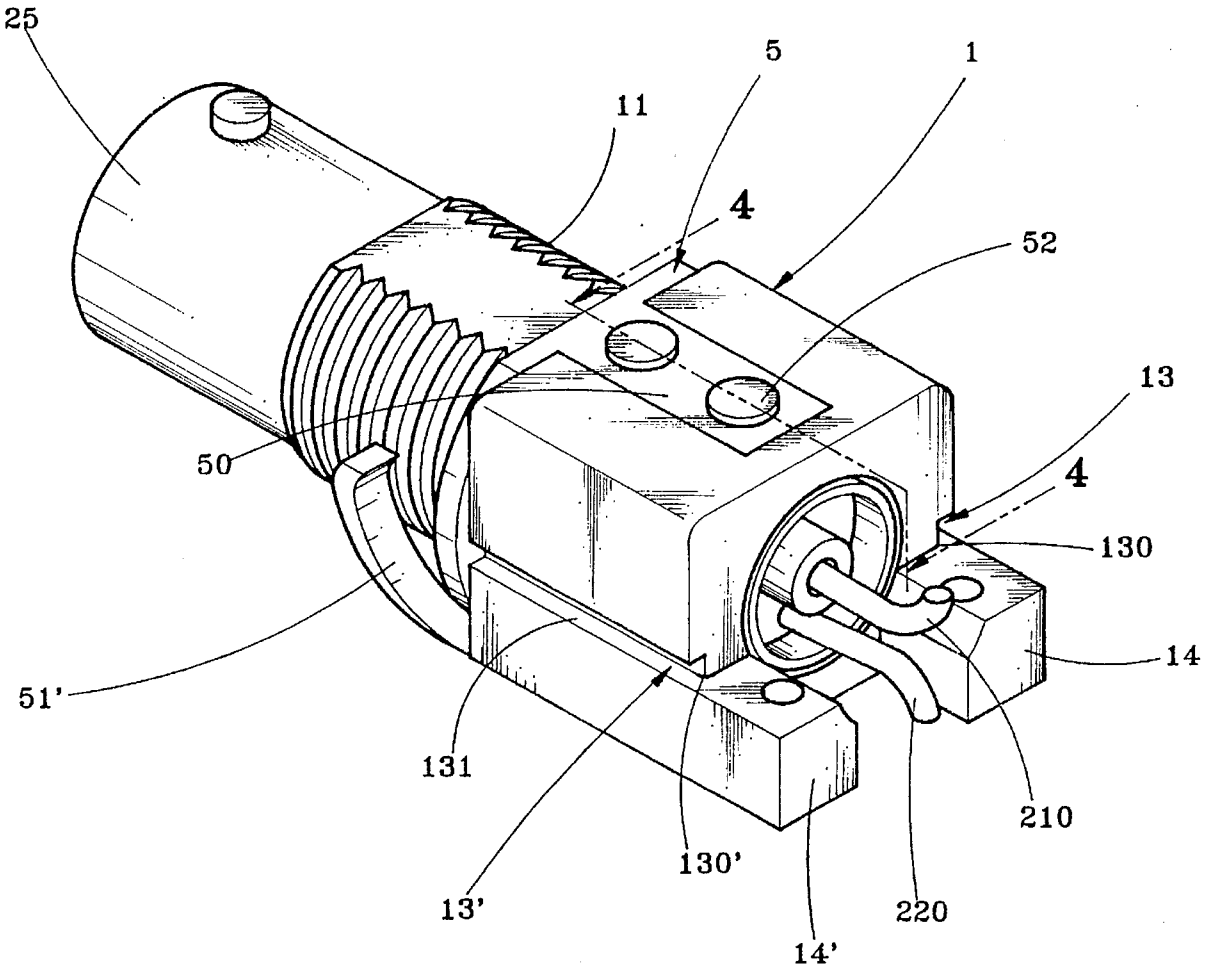
FIG. 2 is an elevational view of a BNC connector according to a first embodiment of the present invention.
Figure 3:
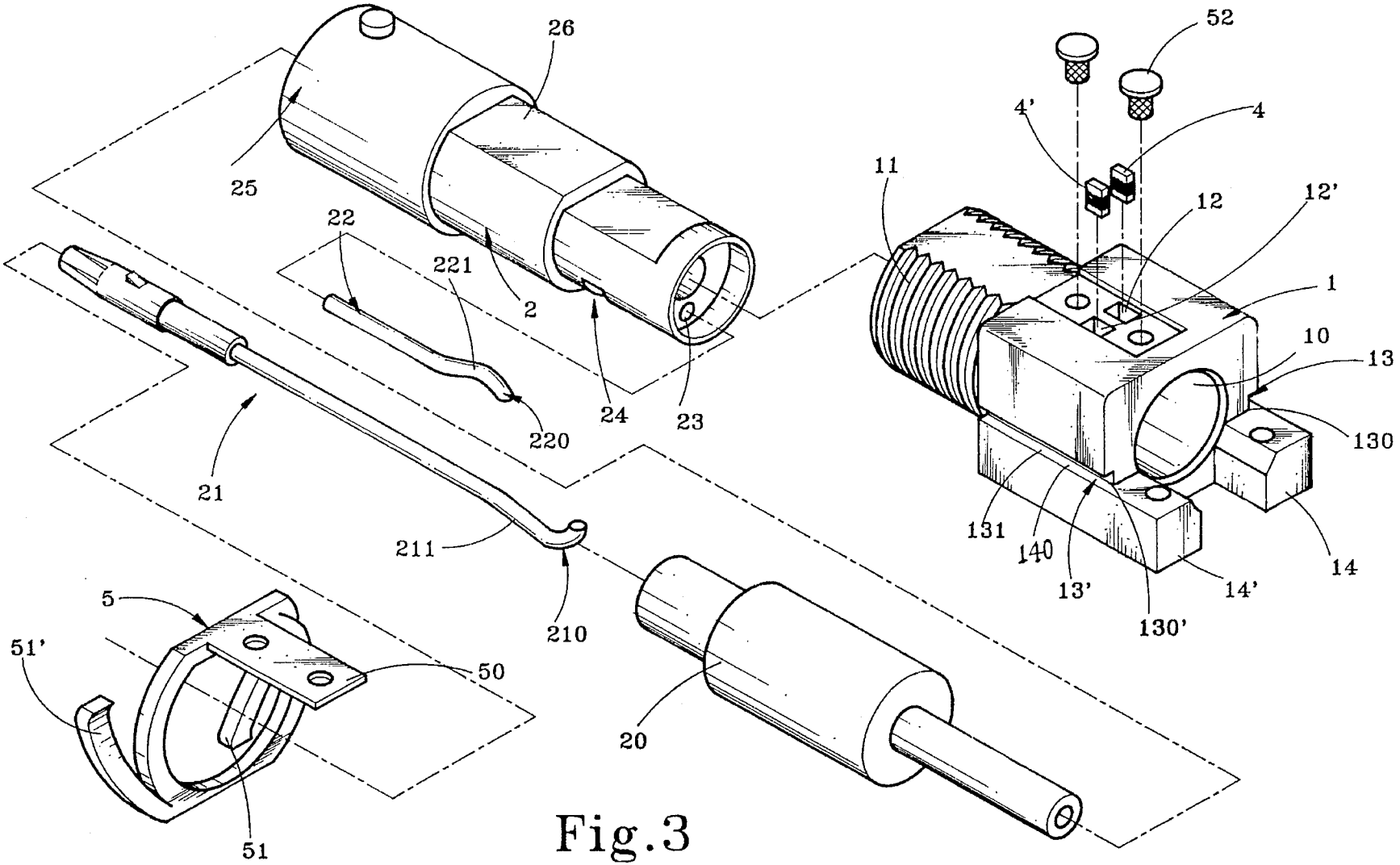
FIG. 3 is an exploded view of the BNC connector shown in FIG. 2.
Figure 4:
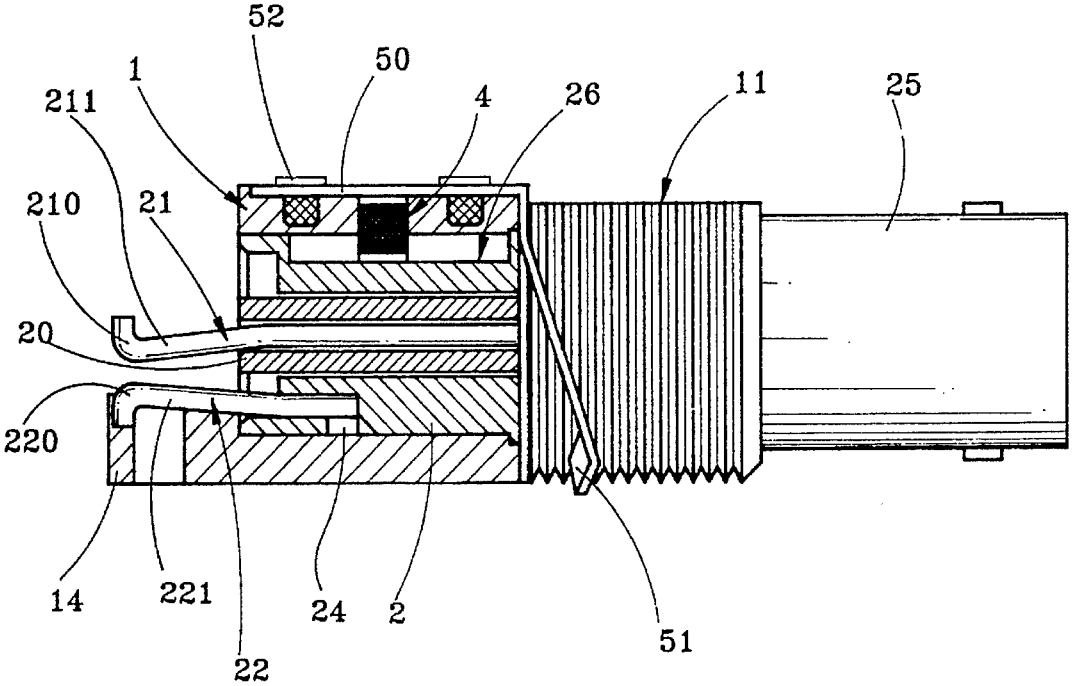
FIG. 4 is a longitudinal view in section of the BNC connector shown in FIG. 2.
Figure 5A:
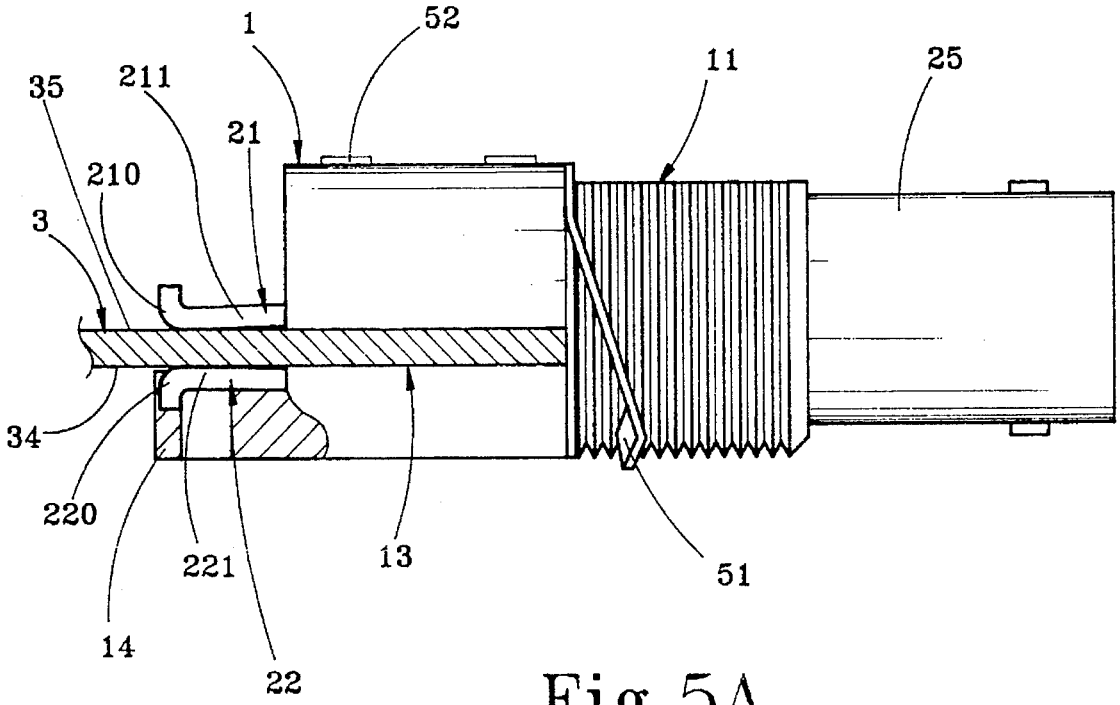
FIG. 5A is a side view in section of FIG. 5.
Figure 5:
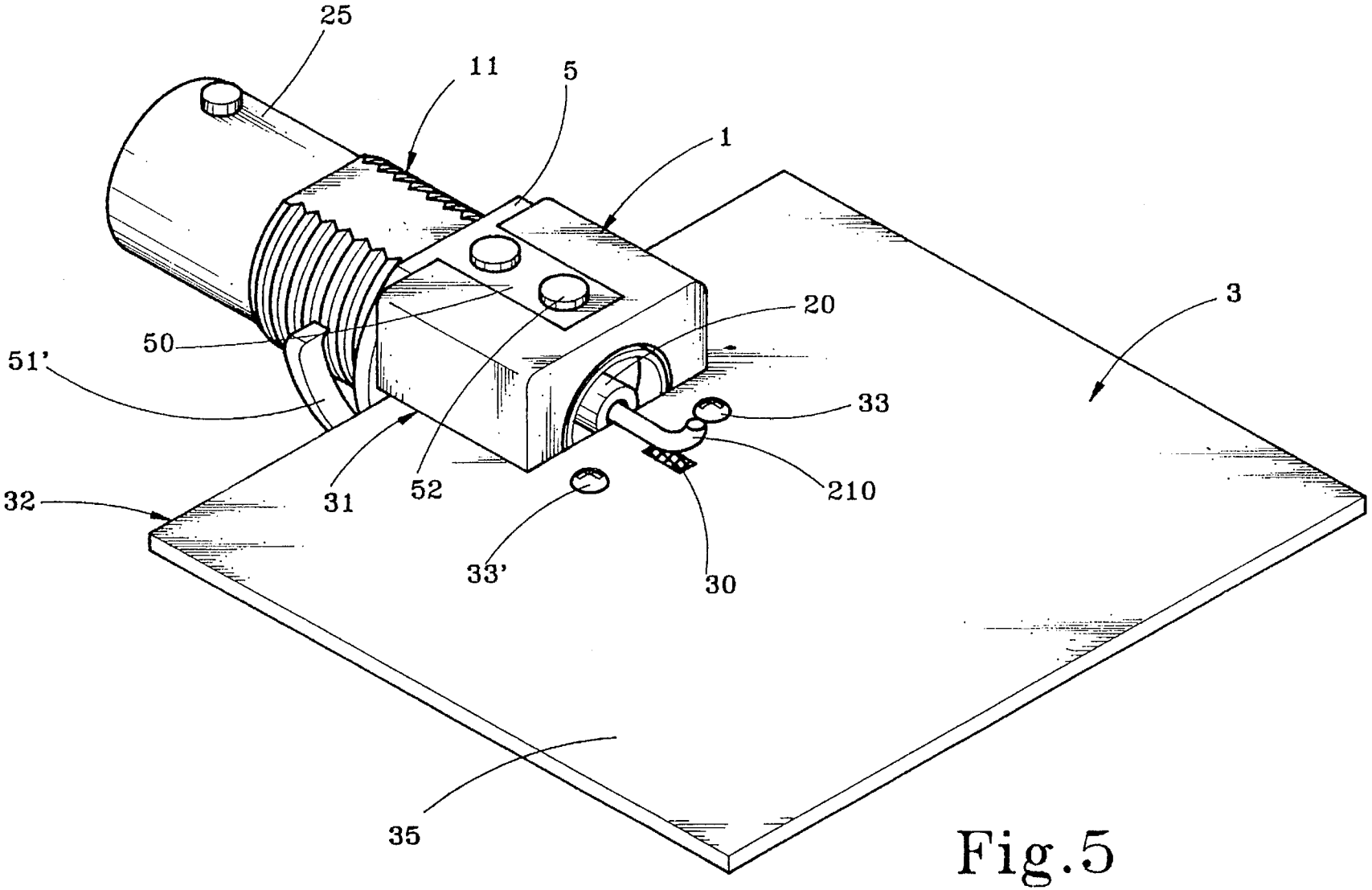
FIG. 5 shows the BNC connector of FIG. 2 installed in a printed circuit board.

Referring to FIGS. 2 and 3, a BNC connector includes an insulative body 1 made of plastics by molding. The insulative body 1 comprises an axial center through hole 10 through the length thereof, and a substantially cylindrical outer thread portion 11 disposed axially at one end. The center through hole 10 of the insulative body 1 receives a BNC jack 2, a hollow terminal shell 20, a signal terminal 21, and a ground terminal 22. The signal terminal 21 is inserted through the hollow terminal shell 20, having a curved portion 211 at one end terminated to a contact tip 210 and extended out of the hollow terminal shell 20 (See FIG. 5). The ground terminal 22 is inserted into an eccentric, axial hole 23 on the BNC jack 2 and then affixed in position by welding, having a curved portion 221 at one end terminated to a contact tip 220 disposed outside the BNC jack 2. The BNC jack 2 comprises a radial hole 24 linked to the inner end of the eccentric, axial hole 23 for drawing away the residual electroplating solution from the BNC jack 2 after the BNC jack 2 was electroplated. When assembled, the signal terminal 21 and the ground terminal 22 are disposed in the insulative body 1 at different elevations with the curved portions 211;221 spaced from and disposed toward each other permitting the contact tips 210;220 to extend outwards in the reversed directions (see FIG. 4). The pitch between the curved portions 211;221 is smaller than the thickness of the PCB (printed circuit board) 3 to be mounted. When mounted, the curved portions 211;221 of the signal and ground terminals 21;22 clamp on the two opposite sides 35:34 of the PCB 3 (see FIG. 5A), and therefore the signal and ground terminal 21;22 are maintained in contact with the respective electric circuit 30 at either side of the PCB 3.

Figure 6:
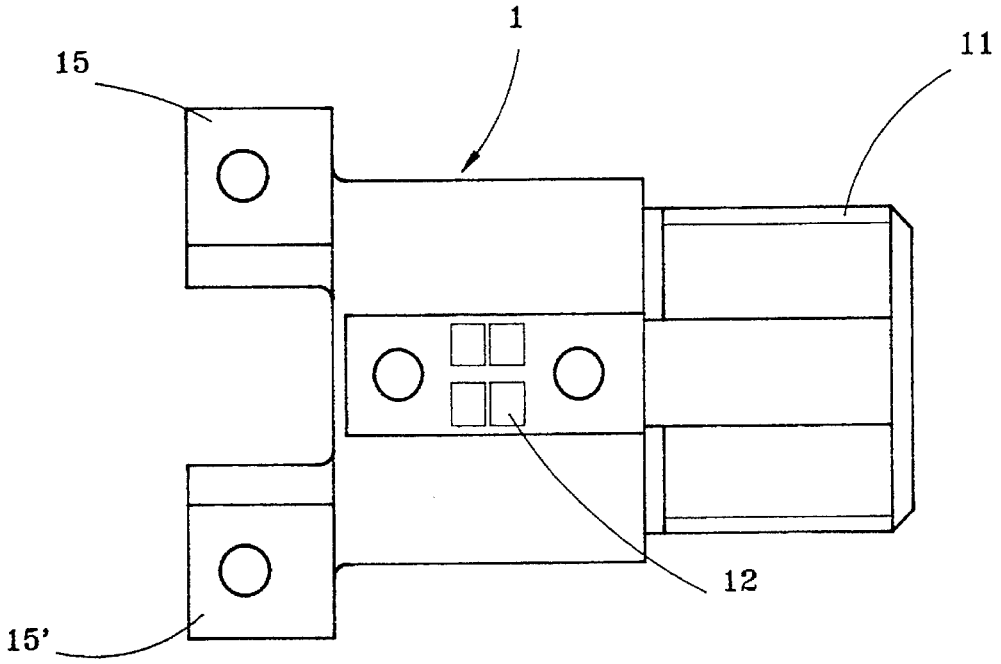
FIG. 6 shows an alternate form of the insulative body of the BNC connector of the present invention.
Figure 7:
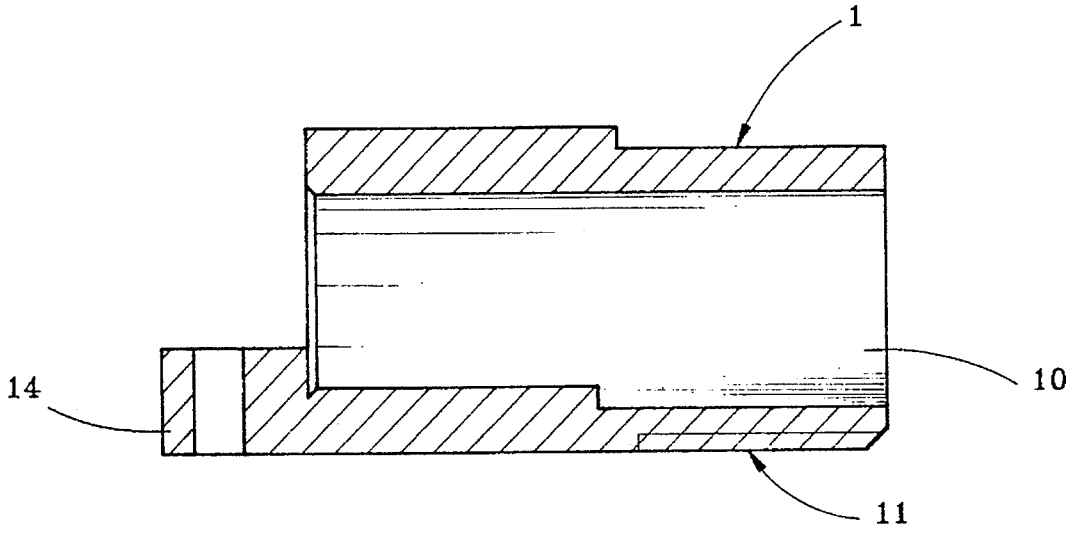
FIG. 7 shows another alternate form of the insulative body of the BNC connector of the present invention.

A metal clip 5 is mounted around the insulative body 1 by rivets 52, having a unitary horizontal top plate 50 and two reversed hooks 51;51'. Two capacitor elements 4;4' are respectively received in two top through holes 12;12' on the insulative body 1 and stopped between the horizontal top plate 50 of the metal clip 5 and a top plane 26 on the BNC jack 2. When the outer thread portion 11 of the insulative body 1 is threaded into a screw hole on the metal frame (not shown), the hooks 51;51' clamp on the two opposite sides of the metal frame, and therefore the metal frame, the metal clip 5, the capacitor elements 4;4', the BNC jack 2, and the ground terminal 22 form a filter circuit. Further, the number of top through holes 12 on the insulative body 1 may be increased so as to receive more capacitor elements (see FIG. 6). If the filter circuit is not required, the metal clip 5 is not necessary, and the top through holes 12;12' and the outer thread portion 11 can be eliminated (see FIG. 7).

Referring to FIG. 3 again, the insulative body 1 comprises two elongated grooves 13;13' disposed axially at two opposite sides along the length thereof, and two wing portions 14;14' disposed axially at two opposite sides at the bottom. The width of the elongated grooves 13;13' is approximately equal to the thickness of the PCB 3. The bottom planes 131 of the elongated grooves 13;13' coincide with the top planes 140 of the wing portions 14;14' respectively, namely the bottom plane of either elongated groove 13 or 13' is the top plane of the respective wing portion 14 or 14'. When the insulative body 1 is inserted into the opening 31 on the PCB 3 (see FIG. 5), the two opposite sides of the opening 31 of the PCB 3 engage into the elongated grooves 13;13', and the front edge 32 of the PCB 3 stops at the metal clip 5, and therefore the curved portions 211;221 of the signal and ground terminals 21;22 respectively clamp on the two opposite sides 35;34 of the PCB 3 (see FIG. 5A) causing the contact tip 210;220 of the signal and ground terminals 21;22 pressed on the respective electric circuit 30 at either side of the PCB 3 (see FIG. 5). At the same time, the two wing portions 14;14' of the insulative body 1 stop at the back side 34 of the PCB 3 and are affixed in position by self-tapping screws 33;33' see FIGS. 5 and 5A). A chamfered edge 130 or 130 may be made on the front end of the elongated groove 13 or 13' for guiding the insulative body 1 into the opening 31 on the PCB 3.

Because the PCB 3 engages into the elongated grooves 13;13' and is affixed to the wing portions 14;14', it does not oscillate and cannot be removed from the BNC connector. When assembled, the contact tips 210;220 of the signal and ground terminals 21;22 are respectively welded to the respective electric circuit 30 on the PCB 3 at either side.

Figure 8:
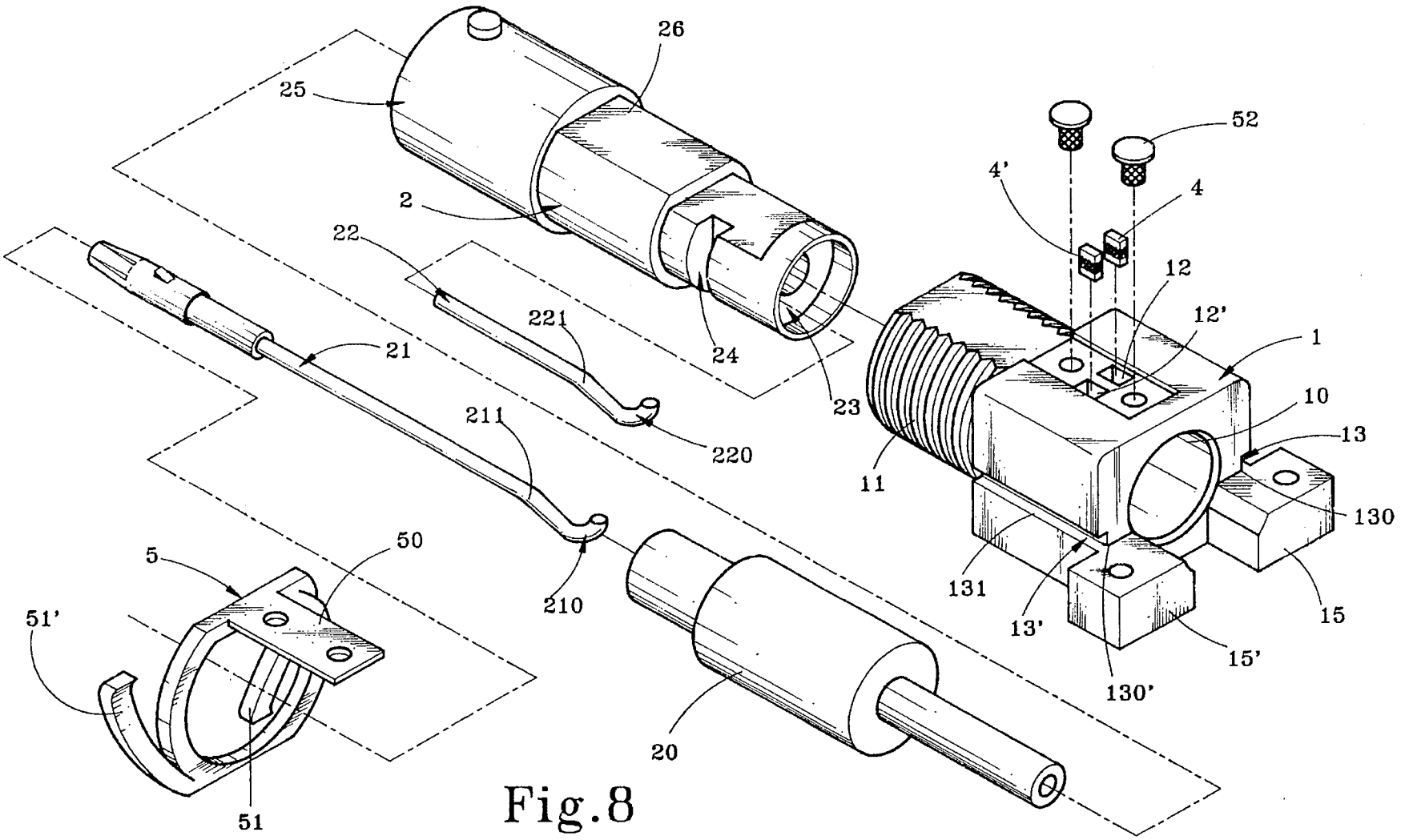
FIG. 8 is an exploded view of a BNC connector according to a second embodiment of the present invention.
Figure 8A:
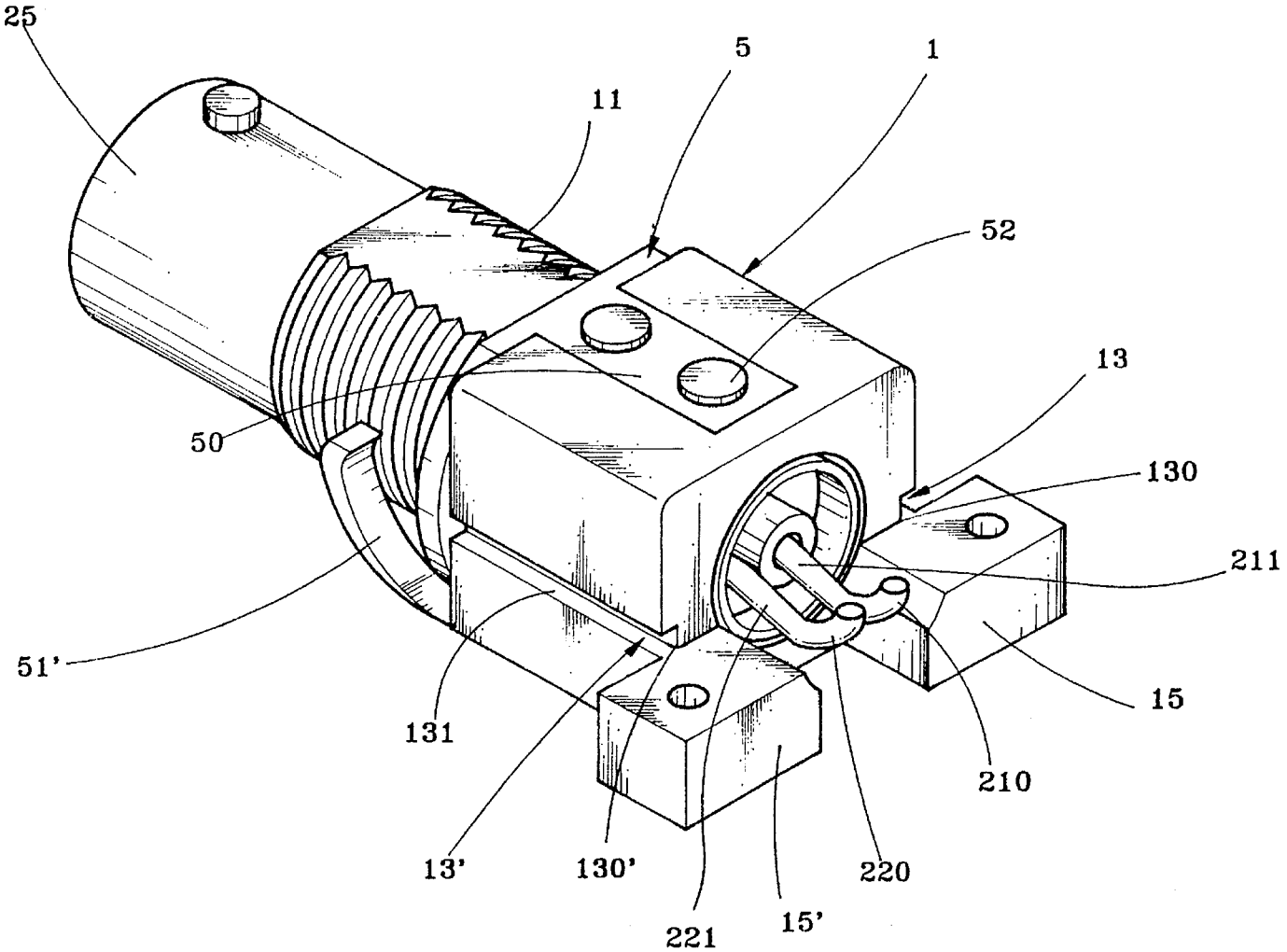
FIG. 8A is an elevational view of the BNC connector of FIG. 8.
Figure 8B:
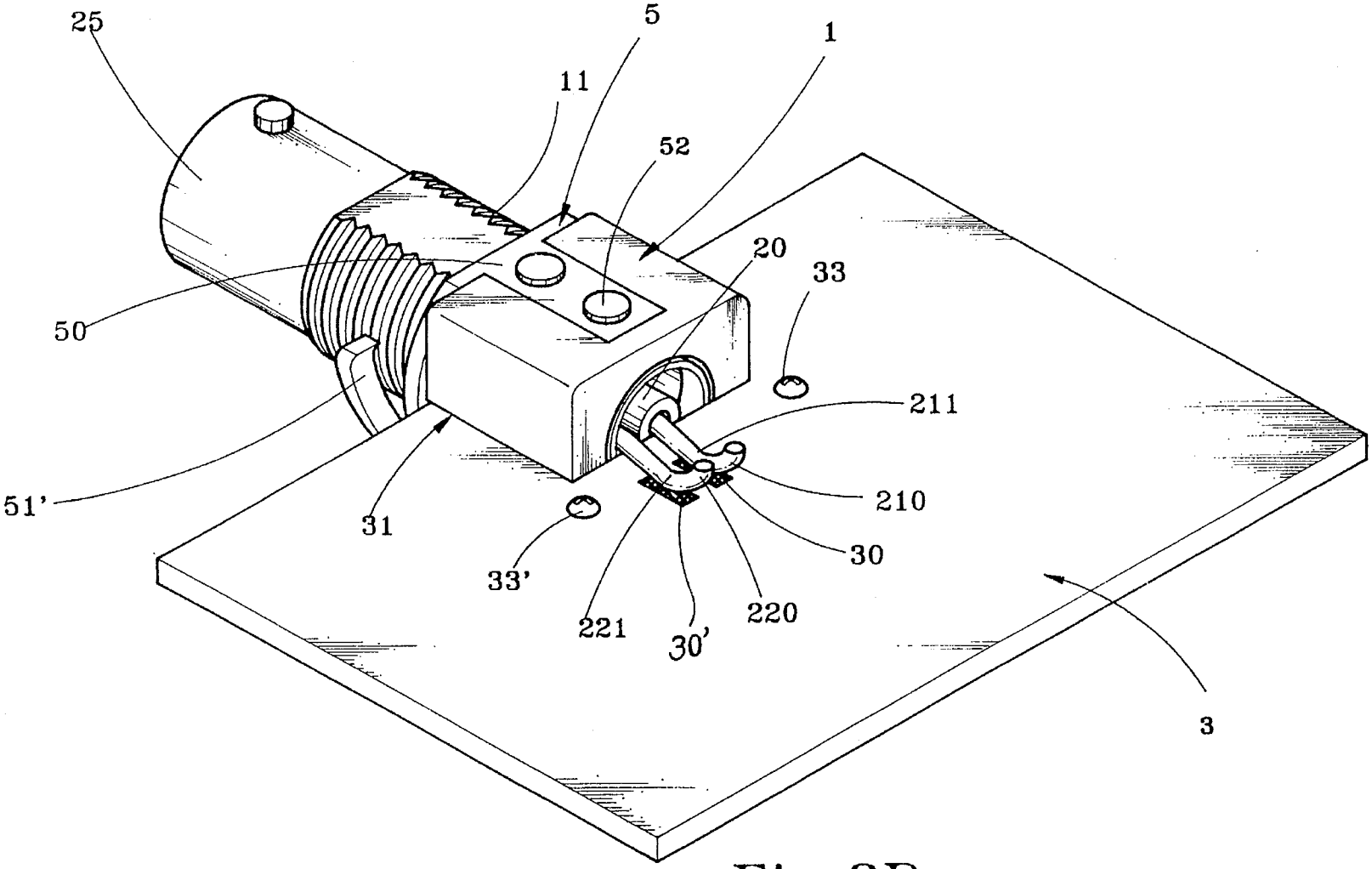
FIG. 8B shows the BNC connector of FIG. 8 installed in a printed circuit board.

Referring to FIGS. 8, 8A, and 8B, therein illustrated is a BNC connector according to a second embodiment of the present invention. According to this embodiment, the contact tips 210;220 of the signal and ground terminals 21;22 are disposed at the same elevation, and therefore they contact the respective electric circuit 30;30' on the PCB at the same side. Therefore, this embodiment is suitable for mounting on a single-sided printed circuit. Of course, the pitch between the two wing portions 15;15' of the insulative body 1 must be made wider than that between the two wing portions 14;14' of the aforesaid first embodiment, so that the signal and ground terminals 21;22 can be disposed at the same elevation within the wing portions 15;15'. The width of the wing portions 15;15'should also be relatively expanded for mounting the self-tapping screws 33;33'.

The depth of the opening 31 on the PCB 3 must be made according to the type of the BNC connector to be matched. If the BNC connector being used includes the metal clip 5, the depth of the opening 31 must be equal or slightly smaller than the length of the elongated grooves 13;13', so that the front edge 32 of the PCB can stop against at the metal ring 5 when the BNC connector is mounted. If the BNC connector being used does not include the metal ring 5, the depth of the opening 31 can be longer for receiving the insulative body 1 and its outer thread portion 11, and therefore only the disconnect coupling portion 25 of the BNC jack 2 extends out of the opening 31 of the PCB 3.

Figure 9:
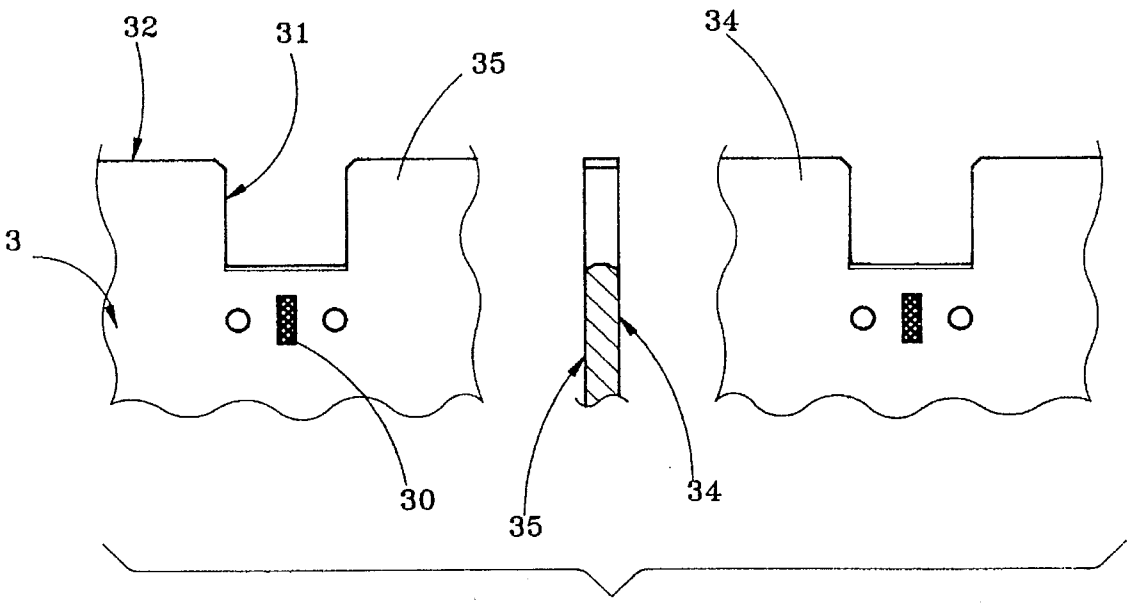
FIG. 9 is the three views of the printed circuit board shown in FIG. 5.
Figure 10:
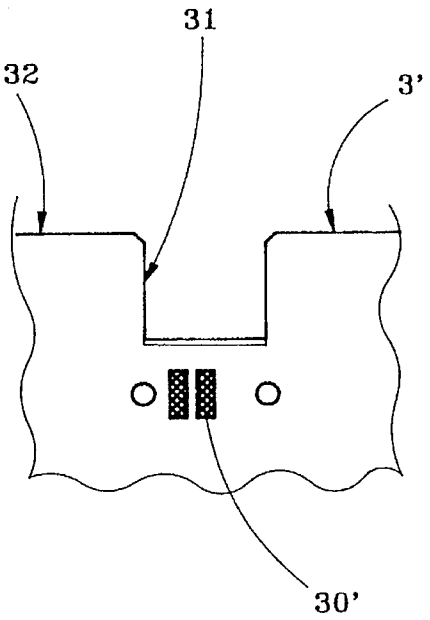
FIG. 10 is a front view of the printed circuit board shown in FIG. 8B.

Referring to FIGS. 9 and 10, there shown are two alternate forms of the PCB for matching the BNC connectors of the first and second embodiments of the present invention respective.

While only few embodiments of the present invention have been shown and described, it will be understood that various modifications and changes could be made thereunto without departing from the spirit and scope of the invention.

I claim:

1. A BNC connector and printed circuit board arrangement comprising a printed circuit board, and a BNC connector having an insulative body at one end fastened to said printed circuit board and a BNC jack at an opposite end extended out of said printed circuit board, said BNC connector comprising a signal terminal and a ground terminal insulated from each other and respectively extended out of said insulative body and connected to a respective circuit on said printed circuit board, wherein:

said insulative body comprises two elongated grooves disposed axially at two opposite sides along the length thereof and made in width equal to the thickness of said printed circuit board, and two wing portions disposed axially at two opposite sides and extended axially forward in the same direction of said signal terminal, said wing portions having a respective top plane, said elongated grooves having a respective bottom plane, the top planes of said wing portions coincided with the bottom planes of said elongated grooves respectively, said wing portions being stopped at said printed circuit board at a back side thereof and affixed thereto by self-tapping screws;

said printed circuit board comprises a rectangular side opening in depth not less than the length of said elongated grooves of said insulative body, the two opposite lateral side walls of said rectangular side opening being respectively inserted into said elongated grooves; and said signal terminal and said ground terminal have a respective curved portion at one end spaced from and disposed toward each other and respectively clamped on said printed circuit board at either side.

2. The BNC connector and printed circuit board arrangement of claim 1 wherein the curved portions of said signal terminal and said ground terminal are terminated to a respective contact tip curved in either direction.

3. The BNC connector and printed circuit board arrangement of claim 1 wherein the curved portions of said signal terminal and said ground terminal are terminated to a respective contact tip curved in the same direction and stopped at said printed circuit board at the same side.

4. The BNC connector and printed circuit board arrangement of claim 1, wherein the curved portions of said signal terminal and said ground terminal are terminated to a respective contact tip curved in the same direction and stopped at said printed circuit board at the same side.

5. A BNC connector and a printed circuit board arrangement comprising:

a printed circuit board; and a BNC connector having an insulative body at one end fastened to said printed circuit board and a BNC jack at an opposite end extended out of said printed circuit board, said BNC connector having a signal terminal and a ground terminal insulated from each other and respectively extended out of said insulative body and connected to a respective circuit on said printed circuit board, wherein:

said insulative body comprises two elongated grooves disposed axially at two opposite sides along the length thereof and made in width equal to the thickness of said printed circuit board, and two wing portions disposed axially at two opposite sides and extended axially forward in the same direction of said signal terminal, said wing portions having a respective top plane, said elongated grooves having a respective bottom plane, the top planes of said wing portions coinciding with the bottom planes of said elongated grooves respectively, said wing portions being stopped at said printed circuit board at a back side thereof and affixed thereto by self-tapping screws;

said printed circuit board comprises a rectangular side opening in depth not less than the length of said elongated grooves of said insulative body, the two opposite lateral side walls of said rectangular side opening being respectively inserted into said elongated grooves; and said signal terminal and said ground terminal have a respective curved portion at one end spaced from and disposed toward each other and respectively clamped on said printed circuit board at the same side.

6. The BNC connector and printed circuit board arrangement of claim 5, wherein the curved portions of said signal terminal and said ground terminal are terminated to a respective contact tip curved in either direction.

* * * * *